United States Patent [19]

Wildi et al.

[11] 4,153,323

[45] May 8, 1979

[54] ELECTRICAL CONNECTOR POST

[75] Inventors: Theodore Wildi, Quebec, Canada; Bertrand Huard, Ancienne-Loretta, Canada

[73] Assignee: Lab-Volt Limited, Quebec, Canada

[21] Appl. No.: 895,526

[22] Filed: Apr. 11, 1978

[51] Int. Cl.[2] ..... H01R 9/08

[52] U.S. Cl. ..... 339/95 R; 339/254 M

[58] Field of Search ..... 339/59 R, 59 M, 61 R, 339/61 M, 95 R, 252 S, 253 S, 254, 255 A, 255 B

[56] References Cited

U.S. PATENT DOCUMENTS

| | | | |
|---|---|---|---|
| 626,708 | 6/1899 | Lundell | 339/254 R |
| 2,487,098 | 11/1949 | Carington et al. | 339/252 S |
| 3,066,274 | 11/1962 | Ellis, Jr. | 339/254 R |

FOREIGN PATENT DOCUMENTS

| | | | |
|---|---|---|---|
| 1201992 | 1/1960 | France | 339/95 R |
| 112291 | 10/1925 | Switzerland | 339/252 S |

OTHER PUBLICATIONS

IBM Bulletin, Latwat, Test Connector, 5-1971, vol. 13, No. 12, p. 3844.

*Primary Examiner*—Joseph H. McGlynn
*Attorney, Agent, or Firm*—Charles E. Brown

[57] ABSTRACT

An electrical connector post, preferably but not exclusively, for use in the construction of experimental electrical circuitry on a circuit board. In a preferred embodiment, the connector comprises two or more electrically conducting post sections having a through bore therein. Resilient means extends through the through bore of each of the conducting post sections and is secured at opposed ends to a respective securement element whereby to urge the post sections toward one another with the through bore of each post section in substantially axial alignment with one another. One of the securement elements is used to mount the connector post to a desired location.

7 Claims, 7 Drawing Figures

ELECTRICAL CONNECTOR POST

BACKGROUND OF INVENTION (a) Field of the Invention

This invention relates to electrical connectors, and more particularly to an electrical connector post having two or more electrically conducting post sections which are urged toward one another by a resilient element extending therealong and permitting insertion of electrical conducting elements between the post sections for retention therebetween.

More particularly, but not exclusively, the electrical connector post of the present invention may be used in the construction of experimental electrical circuitry on a circuit board and the connector post has a mounting base which is connectable to the circuit board.

(b) Description of Prior Art

Various types of electrical connectors are known for providing electrical connection to electrical apparatus, or for mounting on circuit boards for use in the construction of experimental circuitry to be provided in kit form for students, or for use in laboratories for experimental purposes. Such a prior art type connector is, for example, disclosed in U.S. Pat. No. 3,093,431 issued on June 11, 1963 to Richard R. Lewis. However, a particular disadvantage of this type connector is that when it is necessary to insert an electrical conducting element or wire to the connector already having one or two wires attached thereto, the previously attached wires are loosened and sometimes disconnect themselves while trying to connect another conducting element to the post. Furthermore, the elements are connected vertically in a random manner and do not provide a neat display and easy identification of the terminal wires of the circuit elements.

A further disadvantage of known type electrical connectors of this above-mentioned class, is that the many of the connectors are attachable at predetermined locations only on a circuit board in predrilled holes. Thus, once the terminal is connected to a circuit board it cannot be easily and quickly relocated. Also, many of the known connectors are difficult to secure to a circuit board because they require bolting or soldering.

SUMMARY OF INVENTION

It is a feature of the present invention to provide an electrical connector post which substantially overcomes all of the above-mentioned disadvantages of the prior art.

It is a further feature of the present invention to provide an electrical connector post which may be connected as terminals to electrical components and which permits easy and quick attachment of electrical conducting wires thereto and rigid retention thereof.

It is a further feature of the present invention to provide an electrical connector post which also permits easy attachment of probes or connectors of test apparatus thereto.

A still further feature of the present invention is to provide an electrical connector post which is easily and quickly attachable and displaceable on a circuit board.

According to the above features, from a broad aspect, the present invention provides an electrical connector device comprising two or more electrically conducting elements. A resilient means is secured between end ones of the conducting elements to urge the conducting elements in contact with one another and in substantially axial alignment.

According to a further aspect of the present invention there is provided an electrical connector post for use in the construction of experimental electrical circuitry on a circuit board. The connector post comprises, in combination, a mounting base having a release type material in a lower face thereof. The circuit board has at least a part thereof provided with a complementary material of different fibrous construction for releasably engaging the release type material. An electrically conductive post is secured above the mounting base for attaching electrically conductive elements thereto.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
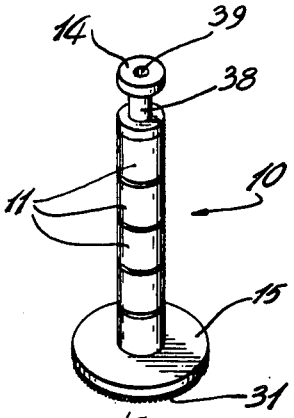
FIG. 1 is a perspective view of the electrical connector post of the present invention.
Figure 2:
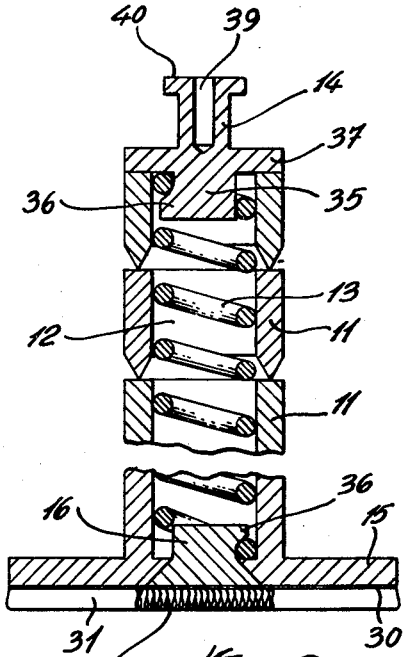
FIG. 2 is a section view, partly fragmented, showing the construction of the electrical connector post of the present invention.

Referring now to the drawings and more particularly to FIGS. 1 to 4, there is shown generally at 10 the electrical connector post of the present invention. The electrical connector post comprises two or more electrically conducting post sections, herein constituted by annular conducting cylinders 11 having a through bore 12 therethrough. A resilient means, herein a helical spring 13 extends through the through bores 12 and is secured at opposed ends to a respective securement element. The top end of the helical spring 13 is secured to a securement flange 36 of an extension portion 35 of an electrical connector terminal 14, constituting one of the securement elements. The lower end of the helical spring 13 is secured to a securement flange 38 of an insert 16 secured in a mounting base 15.

Figure 3:
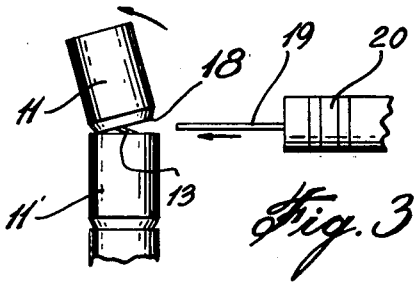
FIG. 3 is a fragmented side view showing the manner in which a wire terminal of an electrical conducting element is secured to the post.

The helical spring 13 is secured in tension within the through bores 12 of the annular conducting cylinders 11 whereby to urge adjacent abutment faces 17 and 18 of adjacent cylinders 11 toward one another. The resilient means such as the spring 13 also keeps the cylinders 11 in substantially axial alignment. The lower abutment face 18 of each cylinder 11 is formed as a pointed annular face whereby to better grip or bite the wire terminal. The pointed annular face also facilitates separation of adjacent abutment faces, as shown in FIG. 3, to permit access between the abutment faces of adjacent cylinders, for inserting wire terminals 19 of electrical conducting elements such as the resistance component 20, or other components, for example, capacitors, transistors, lead wires, etc. The pointed abutment face 18 will resist slippage of the wire terminal of the conducting element (see FIGS. 4A and 4B) to prevent accidental disconnection.

Figure 4A:
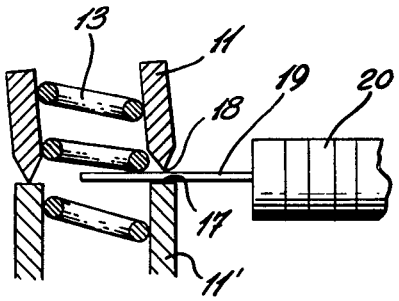
FIGS. 4A and 4B are fragmented section views showing a wire terminal of an electrical conducting element being secured to the post.

In order to separate adjacent abutment faces of opposed cylinders 11 it is necessary to grasp a cylinder with the fingers and to tilt it or hinge it on top of its bottom adjacent cylinder 11', as shown in FIGS. 3 and 4A, thus pulling against the action of the spring 13. Alternatively, the uppermost cylinder 11 can be pulled upwardly to completely separate from the adjacent cylinder 11' to permit insertion of the wire terminal 19 of the electrical component 20. The pointed abutment face 18 facilitates hinging or tilting of the cylinders.

Figure 4B:
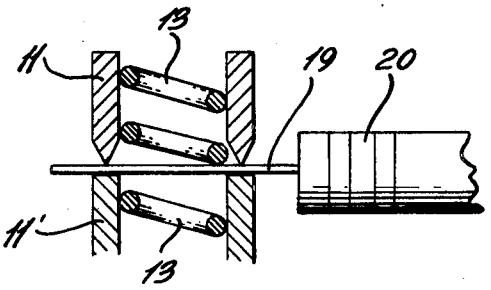

FIGS. 4A and 4B show the electrical component 20 having its wire terminal 19 being secured between adjacent cylinders 11 and 11' with the wire 19 resting on the flat abutment face 17 and being retained by relative pressure between the abutment face 17 and the bottom tapered face 18 of the upper cylinder 11.

Referring now again to FIGS. 1 and 2, there is shown a manner of constructing the mounting base 15. Herein, the base is shown as being of circular contour although this contour can be of any suitable shape. The fixation means of the base 15 is constituted by the lower face 30 of the mounting base 15 being provided with a release type material 31 formed of a plurality of fiber loops 32. This release type material is releasably engageable to a complementary material 33 (see FIG. 5) mounted on a circuit board 34. The complementary material is constituted by a porous layer of fibrous material, made of a plurality of fiber hooks, which permits releasable engagement with the fiber loops 32. Such materials 31 and 33 are known under the registered trademark "Velcro". The material 31 and 33 constitutes the attachment means of the mounting base 15. The base 15 is made of a suitable electrically insulating material.

Referring again to FIG. 2, there is shown the construction of the electrical connector terminal 14 and which comprises a threaded attachment stud portion 35 for securing the upper end 36 of the helical spring 13 thereto. A flange portion 37, of the same diameter as the annular conducting cylinders 11 is provided on top of the stud 35 and abuts against the upper abutment face 17 of the uppermost one of the cylinders 11. The uppermost part of the connector terminal 14 defines an annular groove portion 38 for attachment of snap-on type electrical connectors thereto. An axial hole 39 is provided in the top end 40 of the terminal to accommodate an instrument probe therein for test purposes.

Figure 5:
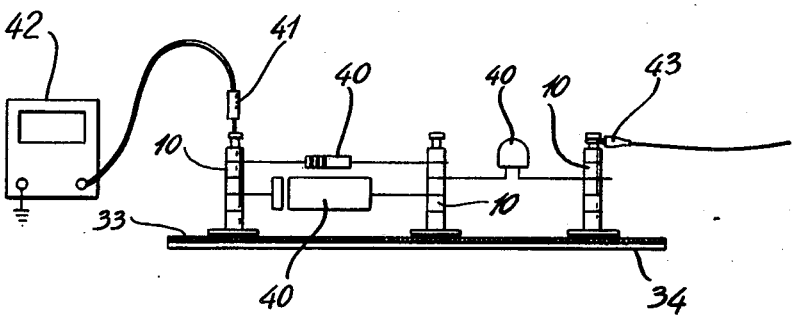
FIG. 5 is an illustration showing electrical connector posts secured on a circuit board having electrical components and test equipment secured to the posts.

Referring now to FIG. 5, there is shown a plurality of connector posts 10 secured to the circuit board 34 having fibrous material 33 on its top face. As illustrated in FIG. 5, a test probe 41 of a testing instrument 42 is inserted in the hole 39 of the connector terminal 14. Also, a snap-on type electrical connector, herein an alligator clip 43, is shown secured in the annular groove 38 of the terminal 14.

Although the mounting base 15 is herein shown for a preferred application, the base of the connector post 10 may take many other forms. For example, the connector post 10 could be used as a connector terminal for electrical devices, such as transformers, test apparatus, etc. (not shown) and the base could be provided with threads for screw connection, etc. Further, the resilient means (which may be a suitable elastic member or a spring or the like elements) could be secured to the end cylinders 11 instead of the manner above described.

Figure 6:
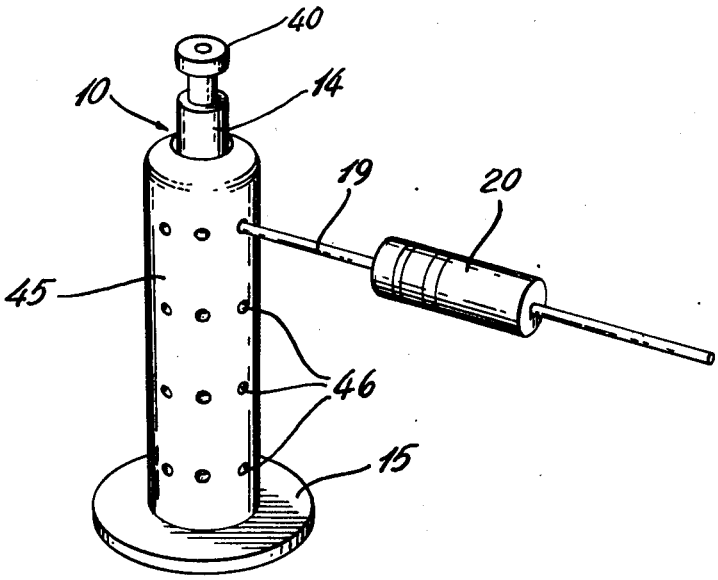
FIG. 6 is a perspective view showing a modification of the connector post of the present invention.

Referring now to FIG. 6 there is shown a different embodiment of construction of the resilient means and herein constituted by a jacket 45 constructed of suitable elastic material to maintain the conducting post sections (not shown), such as cylinders 11, in abutment with one another. In this embodiment the conducting post sections 11 may be simply metallic blocks urged against each other and having at least one abrasive or other form of friction surface to bite or frictionally retain a wire terminal, as in the case with the pointed abutment face 18 of the cylinders 11. The jacket 45 provides insulation about a portion of the post and is suitably stretched between its ends. A plurality of holes 46 permits access of wire terminals 19 of electrical components 20. The post sections 11 (not shown) are separated as previously described.

It is within the ambit of the present invention to provide any other obvious mdofications of the preferred embodiment disclosed herein, provided such modifications fall within the scope of the broadest claims appended hereto.

We claim:

1. An electrical connector device comprising two or more electrically conducting elements, resilient means secured between end ones of said conducting elements to urge said conducting elements in contact with one another and in substantially axial alignment, said resilient means extending through a through bore in at least some of said conducting elements.

2. A connector as claimed in claim 1, wherein each of said conducting elements have a through bore, said resilient means extending through said through bore of each said conducting elements and secured at opposed ends to a respective securement element.

3. A connector as claimed in claim 2, wherein said conducting elements are post sections formed by annular conducting cylinders, each said cylinder having opposed parallel abutment faces.

4. A connector as claimed in claim 3, wherein a lower one of said abutment faces of each cylinder is formed as a pointed annular face.

5. A connector as claimed in claim 4, wherein said resilient means is a helical spring extending through said cylinders to maintain said cylinders in pressure contact at their adjacent abutment faces and in substantially axial alignment.

6. A connector as claimed in claim 5, wherein one end of said helical spring is secured to an electrical connector terminal constituting said securement element, said connector terminal having an annular groove for receiving snap-on type electrical connectors, and a hole in a top end of said connector terminal to accommodate an instrument probe therein.

7. A connector as claimed in claim 5, wherein one end of said helical spring is secured to a mounting base, said mounting base being of insulating material and having attachment means for securing said connector.

* * * * *